US009028203B2

(12) United States Patent
Burgess et al.

(10) Patent No.: US 9,028,203 B2
(45) **Date of Patent: *May 12, 2015**

(54) AIR DIFFUSER SYSTEM FOR INDUSTRIAL PUMPS

(71) Applicant: Weir Minerals Australia Ltd., Artarmon, New South Wales (AU)

(72) Inventors: Kevin Edward Burgess, Carlingford (AU); Michael Christopher Foreman, Northmead (AU)

(73) Assignee: Weir Minerals Australia Ltd. (AU)

( * ) Notice: Subject to any disclaimer, the term of this patent is extended or adjusted under 35 U.S.C. 154(b) by 33 days.
This patent is subject to a terminal disclaimer.

(21) Appl. No.: 13/908,808

(22) Filed: Jun. 3, 2013

(65) Prior Publication Data

US 2014/0154071 A1 Jun. 5, 2014

Related U.S. Application Data

(63) Continuation of application No. 12/450,623, filed as application No. PCT/AU2008/000484 on Apr. 4, 2008, now Pat. No. 8,454,305.

(30) Foreign Application Priority Data

Apr. 5, 2007 (AU) ..... 2007901836

(51) Int. Cl.

| | |
|---|---|
| ***F01D 11/00*** | (2006.01) |
| ***F04D 1/04*** | (2006.01) |
| ***F04D 29/10*** | (2006.01) |
| ***F04D 29/12*** | (2006.01) |

(52) U.S. Cl.

CPC ..... *F04D 1/04* (2013.01); *Y10T 29/49243* (2015.01); *F04D 29/108* (2013.01); *F04D 29/128* (2013.01)

(58) Field of Classification Search

CPC ..... F04D 1/04; F04D 29/108; F04D 29/128
USPC ..... 415/58.1, 58.2, 168.1–168.4, 169.1, 415/169.2, 198.1, 203, 211.2; 416/181–185; 29/889, 889.2
See application file for complete search history.

(56) References Cited

U.S. PATENT DOCUMENTS

| | | | | |
|---|---|---|---|---|
| 5,462,585 | A | 10/1995 | Niskanen et al. | |
| 5,615,997 | A | 4/1997 | Hoglund et al. | |
| 5,827,041 | A | 10/1998 | Charhut | |
| 6,402,461 | B1 | 6/2002 | Tebby | |
| 7,175,384 | B2 * | 2/2007 | Algers | 415/58.2 |
| 7,435,277 | B2 * | 10/2008 | Raussi et al. | 55/406 |
| 2006/0280631 | A1 | 12/2006 | Tsai et al. | |

FOREIGN PATENT DOCUMENTS

| | | | |
|---|---|---|---|
| DE | 3412-774 | A1 | 10/1985 |
| WO | 2006116792 | A1 | 11/2006 |

* cited by examiner

*Primary Examiner* — Nathaniel Wiehe
*Assistant Examiner* — Woody A Lee, Jr.
(74) *Attorney, Agent, or Firm* — Morriss O'Bryant Compagni

(57) ABSTRACT

An air diffuser device suitable for use in an air diffuser system for a centrifugal pump the pump including a pump casing with a pumping chamber therein, an impeller mounted within the pumping chamber for rotation about a rotation axis, the impeller including a front side and a rear side. The air diffuser system comprises one or more passages extending through the impeller from the front side to the rear side, the or each passage having a first opening at the rear side and a second opening at the front side of the impeller. The air diffuser device comprises a main body having a seal side and an impeller side, and at least one channel extending through the main body from the seal side to the impeller side, the or each channel having an intake opening at the seal side, a discharge opening at the impeller side, and a base wall extending through the main body, the base wall having a leading end portion at the seal side, and a trailing end portion at the impeller side, the discharge opening being in fluid communication with the first opening of the passage in the impeller when installed.

11 Claims, 4 Drawing Sheets

AIR DIFFUSER SYSTEM FOR INDUSTRIAL PUMPS

TECHNICAL FIELD

This invention relates generally to industrial pumps, and more specifically though not exclusively to centrifugal pumps such as for example a slurry type end suction centrifugal pump. More particularly the invention is concerned with an air diffuser system suitable for use in such pumps and components therefor.

BACKGROUND ART

Centrifugal pumps are used in a variety of industries to pump fluids. Slurry-type centrifugal pumps are used to process fluids which contain solid materials. Centrifugal pumps in general comprise a pump casing through which a drive shaft extends to rotate an impeller within the casing. A seal mechanism is usually provided which surrounds the drive shaft in the region near where the drive shaft emerges from the pump casing to attach to the impeller. The seal mechanism is provided to seal the pump casing to prevent fluid from leaking about the drive shaft and through the pump casing.

In certain applications, the fluid, or slurry, being processed by the pump may contain relatively large or small quantities of air that will naturally collect at the seal and build-up over time. For example, centrifugal pumps are widely used in flue gas desulphurization (FGD) processes to remove sulphur from the flue gases and thereby reduce the incidence of acid rain. The flue gases are scrubbed in a large tank or vessel by forcing the flue gases through a spray of fine limestone particles that are mixed with water to form a slurry. Centrifugal pumps circulate the limestone slurry from the bottom of the tank or vessel to banks of sprays positioned at the top of the tank or vessel. The flue gases enter near the bottom of the tank and exit at the top of the tank.

Air is often forced into the slurry at or near the bottom of the vessel to aid in the chemical reaction of the limestone particles within the slurry and the sulphur particles within the flue gases. Agitators are also used to circulate and mix the slurry and air. Centrifugal pumps, usually having a high flow rate capability, take the slurry feed from the bottom of the tank. Consequently, the feed slurry entering the pumps has a significant amount of air in it.

Air in slurry can cause a variety of problems in centrifugal pumps. For example, higher air content can reduce the density and pressure developed in the pump, particularly if the air is from three to five percent, or higher, by volume. Additionally, the air, being less dense than water, tends to collect around the pump drive shaft near or at the back of the rotating impeller near the stationary pump casing where the mechanical seal is located.

The mechanical seal typically used in centrifugal pumps generally comprises two adjacent seal members, each having a flattened face which abuts the flattened face of the other seal member. One seal member rotates with the pump shaft and impeller while the other seal member is stationary. Therefore, one seal face is moving while the other is stationary. The adjacent seal faces are held in close contact by springs and by the internal pressures of the pump when in operation. Maintaining a thin fluid film between the seal faces for lubrication and cooling is critical to seal reliability.

The seal members are made of very hard material, such as silicon carbide, so that the infiltration of particulate matter from the slurry usually does not produce any significant wear in the seal faces under normal conditions. However, when there is a higher volume of air in the slurry being processed, the air can infiltrate between the seal faces and displace the liquid film causing dry spots to form between the seal faces. As a result, the adjacent faces begin to operate or run in a dry condition in absence of lubrication, and friction increases with a concomitant increase in heat within the seal. Microcracks and chipping may form in the seal faces and may cause a rounding of the faces so that more slurry can infiltrate between the seal faces. As larger particulates infiltrate between the seal faces, more wear occurs and the seal mechanism finally begins to leak and fail.

The damage that air in slurry can cause to the seal mechanism is recognised in the industry. It has been proposed, for example, that apertures be formed through the back shroud of the impeller (i.e., that portion of the impeller adjacent the drive side of the pump casing) to allow the high pressure fluid to circulate back to the pump intake or low pressure suction side of the pump casing and thereby take some of the air with it. However, the apertures may become clogged with debris or solids from the slurry, or the flow through the apertures may be insufficient to remove the air, and the benefit that may be derived from the apertures is defeated.

Thus, it would be advantageous in the art of industrial pumps and the processing of slurry with higher volumes of air to provide a system for diffusing or continuously removing air from near the seal mechanism to prevent degradation of the seal as previously described, and to improve pump operation.

SUMMARY OF THE INVENTION

According to one aspect of the present invention there is provided an air diffuser device comprising a main body having a first side and a second side, and at least one channel extending through the main body from the first side to the second side, the or each channel being configured so that, when the device is rotated in use, a vortex or swirling flow is created causing material to flow therethrough.

According to another aspect of the present invention there is provided an air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side, a discharge opening at the second side, wherein the device is arranged such in use the or each channel alone places the first side of the body in fluid communication with the first opening of the passage in the impeller.

According to yet another aspect of the present invention there is provided an air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side and a discharge opening at the second side, and wherein the main body has an element which extends radially outwardly therefrom and which is arranged in use to be positioned in a close facing relationship with the rear side of the impeller so as to define a chamber therebetween, such that in use the discharge opening and the first opening of the passage in the impeller are placed in fluid communication via the said chamber.

According to yet another aspect of the present invention there is provided an air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side, a discharge opening at the second side, and the channel including a base wall extending through the main body, the discharge opening arranged in use to be in fluid communication with the first opening of the passage in the impeller.

The base wall of the or each channel may have a leading end portion at the first side, and a trailing end portion at the second side wherein the leading and trailing end portions are flush with the respective first and second sides.

According to yet another aspect of the present invention there is provided an air diffuser system suitable for a centrifugal pump, the system including a rotatable impeller which includes a front side and a rear side, one or more passages extending through the impeller from the front side to the rear side, the or each passage having a first opening at the rear side and a second opening at the front side of the impeller, an air diffuser device as described above, the main body being disposed adjacent the impeller and mounted for rotation therewith, the or each channel being in fluid communication with a respective first opening of the passage in the impeller.

According to yet another aspect of the present invention there is provided a method of installing an air diffuser system as described above in a pump assembly including the step of operatively mounting the air diffuser device and the impeller to a drive shaft of the pump assembly for rotation thereby.

When installed the device is mounted within the pumping chamber for rotation with the impeller. The device may be operatively mounted to the pump drive shaft for rotation thereby with the impeller side of the main body being immediately adjacent the rear side of the impeller so that the or each discharge opening of the or each channel is in fluid communication with the or each passages in the impeller. In another form the device may be operatively connected to the impeller for rotation therewith. The arrangement is such that rotation of the device with the impeller causes slurry and gas to enter the intake opening of the channel and travel along the channel from the leading end of the base wall to the outlet and thereafter through the passage in the impeller via the discharge outlet of the channel. The base wall of the or each channel provides an arcuate shaped, ramped configuration between the leading and trailing ends thereof.

In one form the base wall of the or each said channel is generally arcuate in shape and generally radially spaced from a central axis of the main body and inclined from the leading end portion towards the trailing end portion in a generally partial spiral or helical fashion. Furthermore the or each intake opening may be generally arcuate in shape and generally radially spaced from the central axis and the or each discharge opening is generally arcuate in shape and generally radially spaced from the central axis.

In one embodiment a plurality of the channels may be provided, the intake openings being spaced apart around the first side of the main body and the discharge openings being spaced apart around the second side of the main body. That is the intake and discharge openings are arranged in spaced apart relation from one another along a circular line spaced from and coaxial with the central axis.

The first side and the second side of the main body are generally circular when viewed in the direction of the central axis with a peripheral side wall extending therebetween. A rim may be provided which extends radially outwardly from the second side of the main body. Preferably the rim is substantially resiliently deformable. When installed the rim buts against the rear side of the impeller.

A central aperture may be provided which extends through the main body and is coaxial with the central axis. The aperture is adapted to receive the drive shaft of the pump therethrough when installed.

In an installed position the device is mounted for rotation with the impeller. Rotation of the impeller is caused by rotation of a pump drive shaft to which it is mounted. The arrangement is such that wherein the rotation of the device with the impeller causes slurry and gas to travel along the channel from the leading end portion towards the trailing end portion and thereafter through the passage in the impeller.

BRIEF DESCRIPTION OF THE DRAWINGS

Notwithstanding any other forms which may fall within the scope of the apparatus, method and system as set forth in the Summary, specific embodiments of the method and apparatus will now be described, by way of example, and with reference to the accompanying drawings in which.

DETAILED DESCRIPTION OF SPECIFIC EMBODIMENTS

An air diffuser system 10 which includes a diffuser device 50 according to one preferred embodiment of the invention is illustrated for use with a pump assembly in the form of a centrifugal pump. Only the salient features of the pump are shown because pumps of this type are well known and understood by persons skilled in the art.

Figure 1:
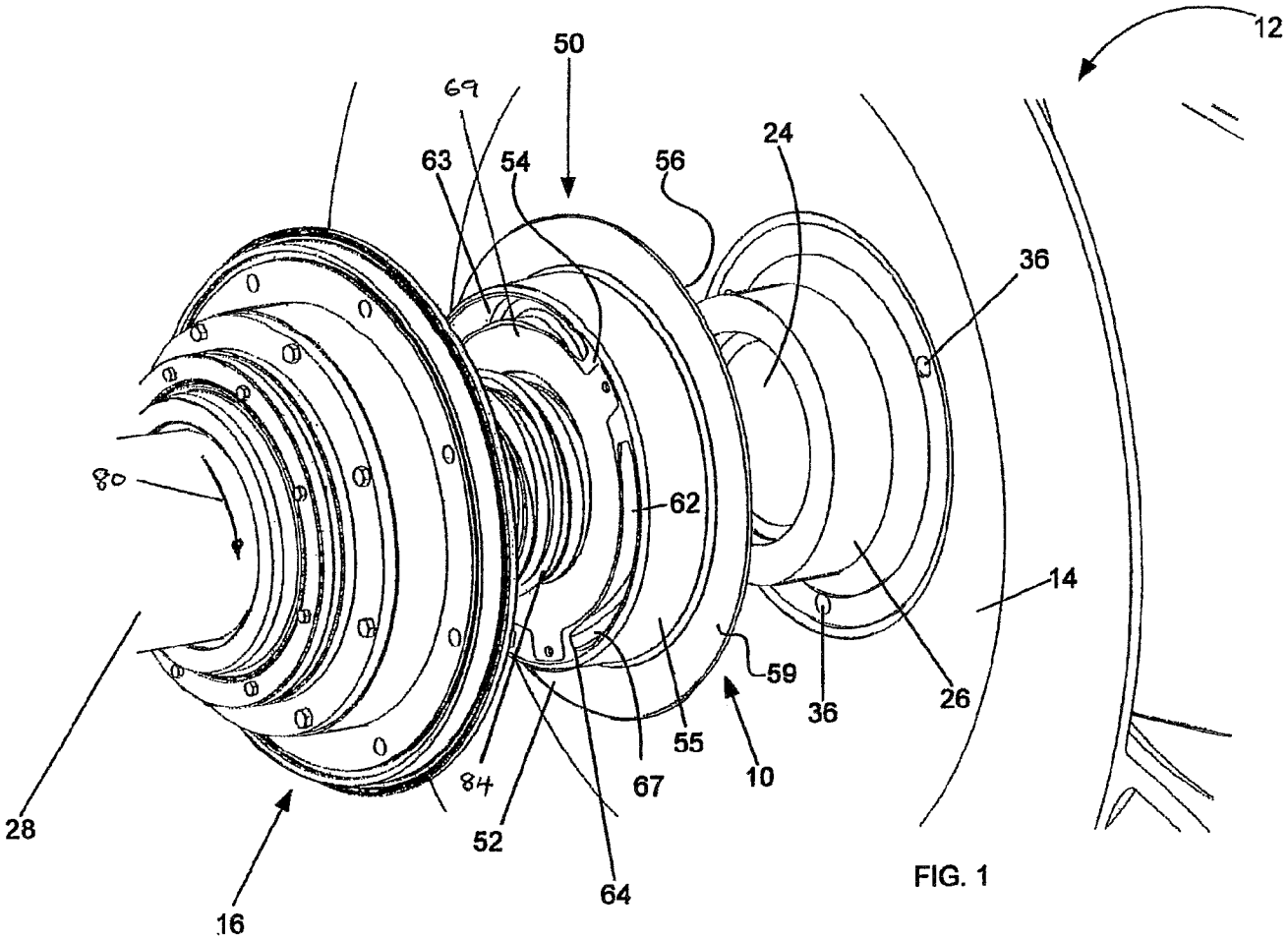
FIG. 1 is an exploded schematic illustration of an air diffuser system according to an embodiment of the invention together with a pump impeller and seal.
Figure 2:
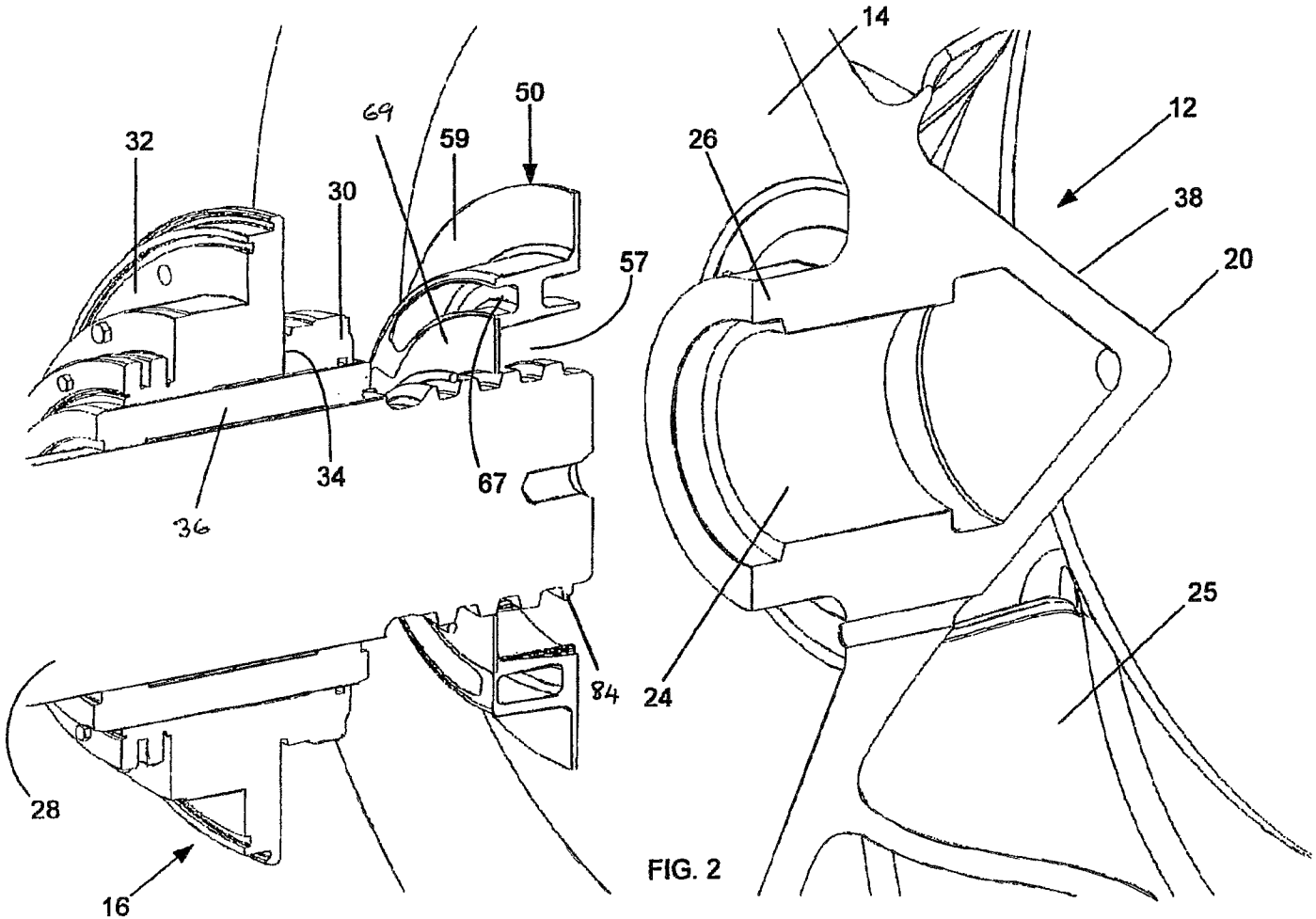
FIG. 2 is a sectional view of that shown in FIG. 1.

With particular reference to FIGS. 1 and 2 the pump assembly includes a pump casing having a pumping chamber therein with an inlet and outlet to and from the chamber. An impeller 12 is rotatably mounted within the chamber and as shown includes a rear side or back shroud 14 a front side or front shroud 38 (FIG. 2) and a plurality of blades 25 terminating at an eye 20. The impeller 12 further includes a hub 26 having an opening 24 therein for receiving a drive shaft 28 which is operatively connected to a drive motor via a pump bearing assembly and gear box (all not shown). The hub 26 is secured to drive shaft 28 by means of threaded portion 84 received within opening 24 which has an internal threaded portion. A seal mechanism 16 provides a seal for the drive shaft 28. As best seen in FIG. 2 the seal mechanism 16 includes a rotating seal member 30 a stationary seal member 32 with a seal face 34 therebetween and a seal shaft sleeve 36. The impeller 12 is positioned within the pump casing with the eye 20 of the impeller 12 facing towards the pump inlet. The seal mechanism 16 is positioned against or in close proximity to the hub 26 of the impeller 12 and surrounds the drive shaft so as to seal the drive shaft 28 and pump casing from fluid slurry being processed by the pump.

Figure 3:
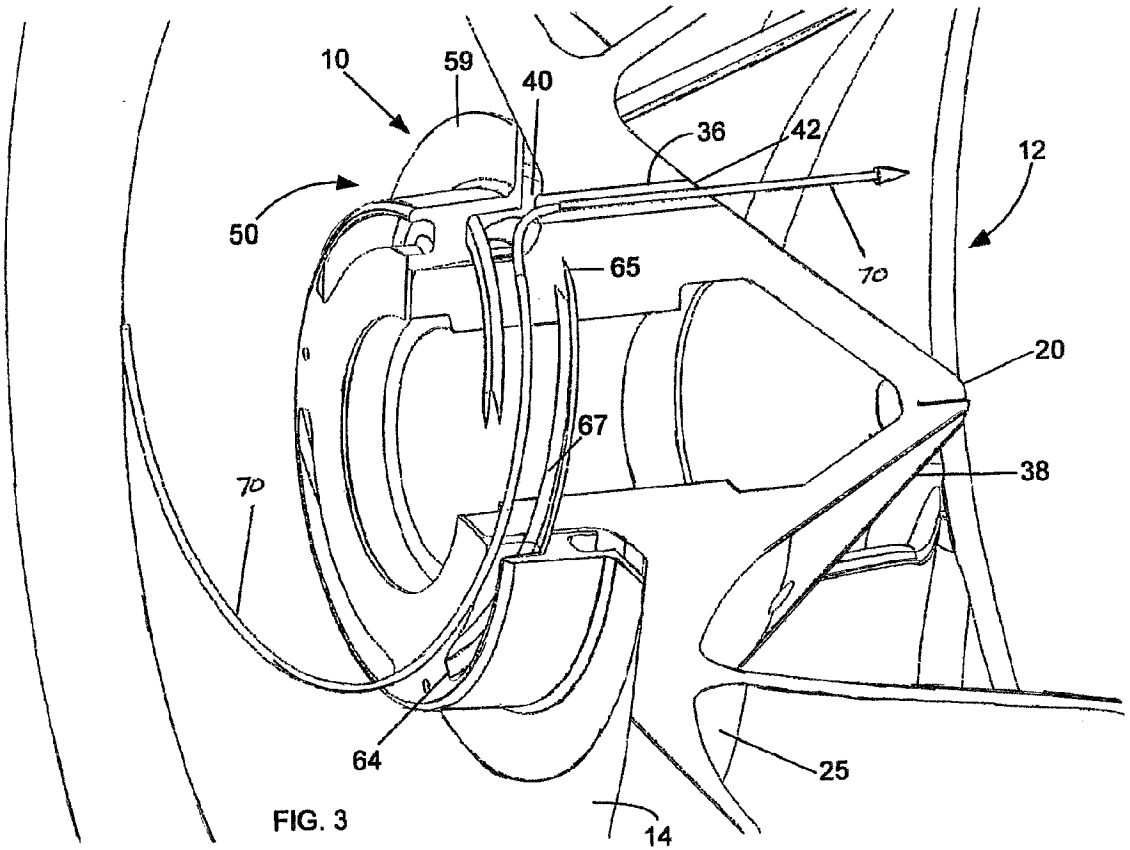
FIG. 3 is a an illustration of the flow path through the diffuser and the impeller.

As shown in FIG. 1 the air diffuser system 10 of the invention comprises a plurality of passages 36 formed in and extending through the impeller 12 from the rear side 14 to the front side 38 of the impeller 12. As shown in FIG. 3 each passage 36 has a first opening 40 through the rear side 14 and a second opening 42 through the front side 38 of the impeller 12. The air diffuser system 10 further comprises an air diffuser device 50 mounted adjacent to the rear side 14 of the impeller.

Figure 5:
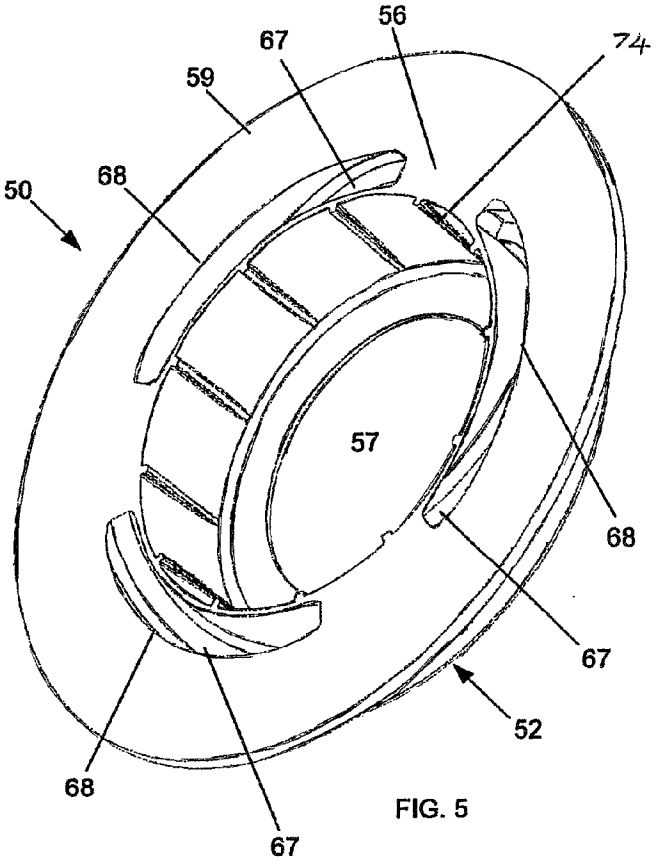
FIG. 5 is a schematic illustration of the air diffuser shown in FIG. 4 from the other side.
Figure 4:
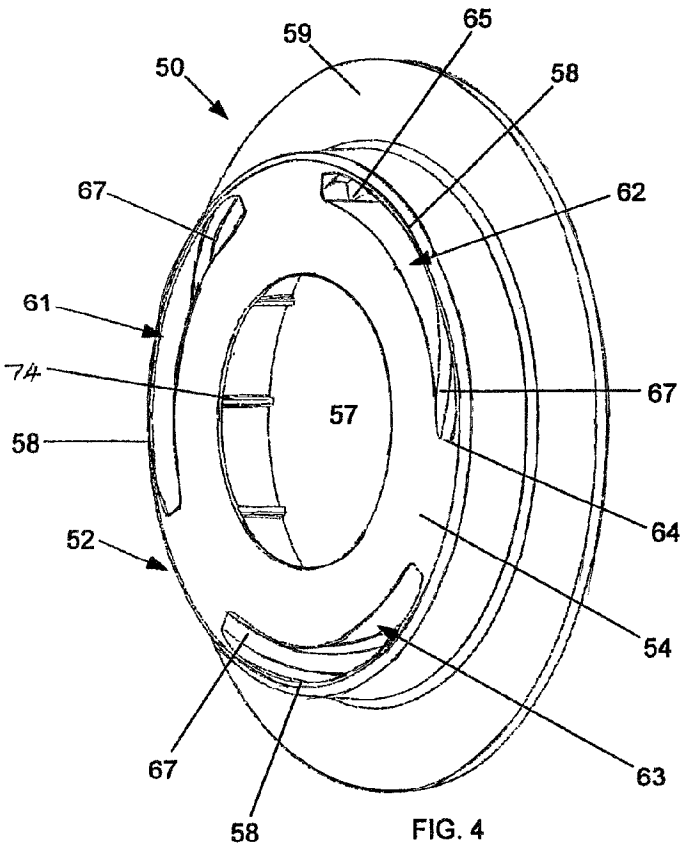
FIG. 4 is a schematic illustration of the air diffuser shown in FIGS. 1 to 3 from one side.

The structure of air diffuser device 50 is best illustrated in FIGS. 4 and 5 and includes a main body 52 having a front or seal side 54, a rear or impeller side 56, a peripheral side wall 55 extending from the seal side to the impeller side and an aperture 57 extending therethrough. The main body 52 further includes an outwardly projecting peripheral rim 59 at the impeller side of the main body.

The device 50 is adapted to be mounted for rotation with the impeller 12. The device 50 is positioned on the hub 26 with the hub 26 extending through aperture 57. The drive shaft extends through aperture 57 and is secured to the hub 26 of the impeller 12 in the manner described earlier. The rim 59 abuts against the rear side 14 of the impeller 12. The rim 59 is resiliently deformable so that in the assembled position it firmly engages the rear side 14 of the impeller. As shown in FIG. 1 a mounting plate 69 is secured to the seal side 54 of the device. When assembled mounting plate 69 is sandwiched between the end face of hub 26 and the end face of seal sleeve 36 so that the device rotates with drive shaft 28. In another arrangement the device 10 may be directly connected to the impeller this being in addition to or alternative to the above connection. Ribs 74 on the inner surface of aperture 57 allows for any variations in the hub diameter which may occur as a result of a casting process.

The device 50 further includes a plurality of channels, recesses or troughs 61, 62 and 63 which are formed between the seal side 54 and the impeller side 56 of the main body 52. Each channel has an intake opening 58, a discharge opening 68 and a base wall 67 having a leading end 64 in the region of the seal side 54 and a trailing end 65 in the region of the impeller side of the main body. The base wall 67 is ramped or sloped from the leading end to the trailing end. The openings 58 and 68 and base wall 67 are curved and extend around the front and rear sides of the main body 52 with the base walls extending in a partial spiral or helical manner. The openings on opposite sides of the base wall 67 open to the seal and impeller sides of the device. The discharge openings 68 are in communication with an annular chamber which is between the rim 59 and the periphery of aperture 57 when the device is installed. The annular chamber is in communication with passages 36 in the impeller 12. To one side of each base wall 67 there is a region between the base wall and the intake opening and to the other side of the base wall there is a region between the base wall and the discharge opening.

In use rotation of the impeller 12 and device 50 mounted adjacent thereto in the direction of arrow 80 in FIG. 1 causes air and slurry to travel along the channels into the chambers and then through the passages in the impeller. The arrangement is such that the intake opening of one channel is in fluid communication with the discharge opening below the base wall of the next adjacent channel inlet. For example material entering the intake opening of channel 61 passes along the base wall thereof to the discharge opening of channel 63. The ramped or sloped base walls are configured so as to act similarly to a screw thread collecting the slurry and air and forcing it through the passages in the impeller. FIG. 3 illustrates the flow path through the device 10 and impeller 12, the arrow 70 illustrating the flow path. The device may be formed from any suitable materials such as for example plastics such as polyurethane.

In one method of installation the device 10 is mounted to the hub of the impeller 12, the hub 26 extending through aperture 57 in the device. The rim 59 of the device is disposed adjacent the rear side 14 of the impeller 12. The drive shaft 28 is secured to the opening 24 in the hub 26 and mounting plate 69 sandwiched between the end face of the hub 26 and the end face of the seal sleeve 36 so that the device will rotate with the impeller and the drive shaft. In the final fitted position the rim 59 is brought into close contact with the rear side 14 of the impeller 12 so that it is in a deformed state. The air diffuser device of the present invention may be incorporated into newly cast impellers or may be retrofitted to existing impellers in existing pumps. It will be appreciated that this invention has general application to all pumps where the presence of air in the pumped fluid can result in a mechanical seal "running dry".

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear" and the like are used as words of convenience to provide reference points and are not to be construed as limiting terms.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Finally, it is to be understood that various alterations, modifications and/or additions may be incorporated into the various constructions and arrangements of parts without departing from the spirit or ambit of the invention.

The invention claimed is:

1. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side and a discharge opening at the second side, the or each channel further comprising a base wall having a leading end portion at the first side of the main body and a trailing end portion at the second side of the main body, wherein the leading and trailing end portions are flush with the respective first side and second side and the base wall of the or each said channel is generally arcuate in shape and generally radially spaced from a central axis of the main body and inclined from the leading end portion towards the trailing end portion, and wherein the main body has an element which extends radially outwardly therefrom and which is arranged in use to be positioned in a close facing relationship with the rear side of the impeller so as to define a chamber therebetween, such that in use the discharge opening and the first opening of the passage in the impeller are placed in fluid communication via the said chamber.

2. An air diffuser device according to claim 1 wherein the or each intake opening is generally arcuate in shape and generally radially spaced from the central axis.

3. An air diffuser device according to claim 1 wherein the or each discharge opening is generally arcuate in shape and generally radially spaced from the central axis.

4. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having a base wall, each base wall being generally partially spiral or helical in shape, and the or each channel having an in use intake opening at the first side and a discharge opening at the second side, and wherein the main body has an element which extends radially outwardly therefrom and which is arranged in use to be positioned in a close facing relationship with the rear side of the impeller so as to define a chamber therebetween, such that in use the discharge opening and the first opening of the passage in the impeller are placed in fluid communication via the said chamber.

5. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, wherein said first side and said second side of the main body are each generally circular when viewed in the direction of a central axis, with a peripheral side wall extending therebetween, and with a rim extending radially outwardly from the second side of the main body, and at least one channel extending through the main body from the first side to the second side, the or each channel having an in use intake opening at the first side and a discharge opening at the second side, and wherein the main body has an element which extends radially outwardly therefrom and which is arranged in use to be positioned in a close facing relationship with the rear side of the impeller so as to define a chamber therebetween, such that in use the discharge opening and the first opening of the passage in the impeller are placed in fluid communication via the said chamber.

6. An air diffuser device according to claim 5 wherein the rim is substantially resiliently deformable.

7. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side, a discharge opening at the second side, and the or each channel further comprising a base wall having a leading end portion at the first side of the main body and a trailing end portion at the second side of the main body, wherein the leading and trailing end portions are flush with the respective first side and second side of the main body, and wherein the base wall of the or each said channel is generally arcuate in shape and generally radially spaced from a central axis of the main body and inclined from the leading end portion towards the trailing end portion, wherein the device is arranged such that in use the or each channel alone places the first side of the body in fluid communication with the first opening of the passage in the impeller.

8. An air diffuser device according to claim 7 wherein the or each intake opening is generally arcuate in shape and generally radially spaced from the central axis.

9. An air diffuser device according to claim 7 wherein the or each discharge opening is generally arcuate in shape and generally radially spaced from the central axis.

10. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, and at least one channel extending through the main body from the first side to the second side, the or each channel having an in use intake opening at the first side, a discharge opening at the second side and a base wall, each base wall being generally partially spiral or helical in shape, and wherein the device is arranged such that in use the or each channel alone places the first side of the body in fluid communication with the first opening of the passage in the impeller.

11. An air diffuser device suitable for use in an air diffuser system for a centrifugal pump, the pump including a pump casing with a pumping chamber therein, an impeller mounted within the pumping chamber for rotation about a rotation axis, the impeller including a front side and a rear side, the air diffuser system comprising one or more passages extending through the impeller from the front side to the rear side, the or each passage having a first opening at the rear side and a second opening at the front side of the impeller, the air diffuser device comprising a main body having a first side and a second side, including a rim extending radially outwardly from the second side of the main body, wherein the rim is substantially resiliently deformable, and at least one channel extending through the main body from the first side to the second side, the or each channel having an in use intake opening at the first side, a discharge opening at the second side, wherein the device is arranged such that in use the or each channel alone places the first side of the body in fluid communication with the first opening of the passage in the impeller.

* * * * *